US007872616B2

(12) United States Patent
Choi

(10) Patent No.: US 7,872,616 B2
(45) Date of Patent: Jan. 18, 2011

(54) PLASMA DISPLAY APPARATUS AND DRIVING METHOD THEREOF

(75) Inventor: Jeong Pil Choi, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 1002 days.

(21) Appl. No.: 11/222,075

(22) Filed: Sep. 9, 2005

(65) Prior Publication Data

US 2006/0055635 A1 Mar. 16, 2006

(30) Foreign Application Priority Data

Sep. 10, 2004 (KR) ..... 10-2004-0072768

(51) Int. Cl.
*G09G 3/28* (2006.01)

(52) U.S. Cl. ..... 345/68; 345/60

(58) Field of Classification Search ..... 345/37, 345/94–95, 204, 208–215, 41–42, 60–72; 315/160–161, 167–169.4
See application file for complete search history.

(56) References Cited

U.S. PATENT DOCUMENTS

| | | | | |
|---|---|---|---|---|
| 2002/0033675 | A1 * | 3/2002 | Kang et al. | 315/169.1 |
| 2002/0097003 | A1 * | 7/2002 | Takamori et al. | 315/169.4 |
| 2002/0186184 | A1 * | 12/2002 | Lim | 345/60 |
| 2003/0057851 | A1 | 3/2003 | Roh et al. | |

(Continued)

FOREIGN PATENT DOCUMENTS

| | | | |
|---|---|---|---|
| CN | 1495690 | | 5/2004 |
| CN | 1534566 | | 10/2004 |
| EP | 1 182 634 | A2 | 2/2002 |
| KR | 2003-0027173 | A * | 4/2003 |

OTHER PUBLICATIONS

Chinese Office Action dated Apr. 7, 2010 and English-language translation.

*Primary Examiner*—Sumati Lefkowitz
*Assistant Examiner*—Jonathan Horner
(74) *Attorney, Agent, or Firm*—KED & Associates, LLP

(57) ABSTRACT

There is provided a plasma display apparatus and a driving method thereof, and more particularly, to a plasma display apparatus which drives an electrodes and a driving method thereof. The plasma display apparatus includes a plasma display panel including an electrodes; a first voltage supply unit supplying a first voltage to the electrodes at a setup period; and a setup/scan operation unit supplying a ramp-up pulse to the electrodes at the setup period with one voltage source and supplying a second voltage to the electrodes at an address period with the one voltage source. The driving apparatus of a plasma display panel includes a plasma display panel including an electrodes; a first voltage supply unit supplying a first voltage; a first setup supply unit supplying a first ramp-up pulse rising from the first voltage to a first sum voltage corresponding to a sum of the first voltage and the second voltage to the electrodes; and a second setup supply unit supplying a second ramp-up pulse rising to a second sum voltage corresponding to a sum of the first voltage, the second voltage, and the third voltage to the electrodes after the first ramp-up pulse is applied and a second setup supply unit supplying the third voltage to the electrodes when scanning the electrodes. Therefore, it is possible to reduce the production cost by decreasing the number of components and improve a driving efficiency by raising a voltage of a setup waveform at a reset period.

4 Claims, 14 Drawing Sheets

U.S. PATENT DOCUMENTS

2004/0012547 A1* 1/2004 Lee ..... 345/60
2004/0046509 A1* 3/2004 Sakita ..... 315/169.3
2004/0085262 A1* 5/2004 Lee ..... 345/41
2004/0090395 A1* 5/2004 Park ..... 345/41
2004/0155836 A1* 8/2004 Kim et al. ..... 345/60
2004/0183753 A1* 9/2004 Choi et al. ..... 345/33

* cited by examiner

PLASMA DISPLAY APPARATUS AND DRIVING METHOD THEREOF

This Nonprovisional application claims priority under 35 U.S.C. §119(a) on patent application No. 10-2004-0072768 filed in Korea on Sep. 10, 2004 the entire contents of which are hereby incorporated by reference.

BACKGROUND OF THE INVENTION

1. Field of the Invention

The present invention relates to a plasma display apparatus and a driving method thereof, and more particularly, to a plasma display apparatus which drives electrodes and a driving method thereof.

2. Description of the Background Art

Generally, in a plasma display panel, each cell is made by a barrier rib formed between a front substrate and a back substrate and main discharge gas such as Neon (Ne), Helium (He) or mixing gas (Ne+He) of Neon and Helium and inert gas containing small quantity of Xenon (Xe) are filled in an each cell. When the panel is discharged by a high frequency voltage, inert gas generates vacuum ultraviolet rays and allows a phosphor formed between the barrier ribs to emit light and thus an image is embodied. Since such a plasma display panel can be manufactured to be thin and have light weight, it is in the spotlight as a next generation display device.

FIG. 1 is a perspective view of general plasma display panel. As shown in FIG. 1, in the plasma display panel, a front substrate 100 that is a display surface in which an image is displayed and a back substrate 110 forming a back surface are coupled to each other with disposed in parallel apart by a predetermined distance.

The front substrate 100 is formed by a pair of a scan electrode 101 and a sustain electrode 102 for discharging to each other in one discharge cell and sustaining light emitting of a cell, that is, a scan electrode 101 and the sustain electrode 102 having a transparent electrode made of a transparent ITO material and a bus electrode made of a metal material. The scan electrode 101 and the sustain electrode 102 limits a discharge current and are covered with one or more dielectric layer 103 for isolating pairs of electrodes, and a protective layer 104 deposited with Magnesium Oxide (MgO) is formed on the upper surface of the dielectric layer 103 to facilitate a discharge condition.

The back substrate 110 is formed by disposing in parallel a stripe-type (or well type) barrier rib 111 for forming a plurality of discharge spaces, that is, discharge cells. Further, a plurality of address electrodes 112 generating vacuum ultraviolet rays by performing address discharge are disposed in parallel to the barrier rib 111. RGB phosphors 113 emitting visible rays for displaying an image when the address discharge is performed are coated on an upper side surface of the back substrate 110. White dielectric substance 114 for protecting the address electrode 112 and reflecting visible rays emitted from the phosphor 113 to the front substrate 100 is formed between the address electrode 112 and the phosphor 113.

A method of embodying an image gray level in such a plasma display panel will be described with reference to FIG. 2.

FIG. 2 is a diagram illustrating a method of embodying the image gray level of a conventional plasma display apparatus. As shown in the figure, in a method of expressing a image gray level of the conventional plasma display apparatus, one frame is divided into several subfields having the different light emitting number and each subfield is again divided into a reset period (RPD) for initializing all cells, the address period (APD) for selecting a cell to be discharged, and the sustain period (SPD) for embodying a gray level depending on the number of the discharge. For example, when an image is displayed in 256 gray levels, a frame period (16.67 ms) corresponding to 1/60 second is divided into 8 subfields (SF1 to SF8) and each of 8 subfields (SF1 to SF8) is again divided into the reset period, the address period, and the sustain period.

The reset period and the address period of each subfield are equal in each subfield. The address discharge for selecting a cell to be discharged is generated by the voltage difference between an address electrode and a transparent electrode that is a scan electrode. The sustain period is increased in a ratio of $2^n$ (n=0, 1, 2, 3, 4, 5, 6, 7) in each subfield. In this way, since the sustain period is different in each subfield, by adjusting the sustain period of each subfield, that is, the sustain discharge number, the gray level of an image is expressed. Driving waveforms according to a driving method of the plasma display apparatus is shown in FIG. 3.

FIG. 3 is a diagram illustrating driving waveforms according to a driving method of the conventional plasma display apparatus. As shown in the figure, the plasma display apparatus is driven by dividing the period into the reset period for initializing all cells, the address period for selecting cells to discharge, the sustain period for sustaining the discharge of the selected cell, and an eraser period for erasing wall charges within the discharged cell.

At the reset period, a ramp-up waveform is simultaneously applied to all scan electrodes at a setup period. Weak dark discharge occurs in discharge cells of a full screen by the ramp-up waveform. Positive polarity wall charges are stacked on the address electrode and the sustain electrode and a negative polarity wall charges are stacked on the scan electrode, by the setup discharge.

At a setdown period, after a ramp-up waveform is supplied, because a ramp-down waveform falling from a positive polarity voltage lower than a peak voltage of the ramp-up waveform to a specific voltage level of a ground (GND) level voltage or less causes feeble eraser discharge within cells, wall charges excessively formed in the scan electrode are fully erased. Wall charges enough to stably cause the address discharge by the setdown discharge uniformly remain within cells.

At the address period, when a negative polarity scan signal is sequentially applied to the scan electrodes, a scan signal is simultaneously synchronized and thus a positive polarity data signal is applied to the address electrode. The address discharge is generated within the discharge cells to which the data signal is applied while the wall voltage generated at the reset period is added to the voltage difference of the scan signal and the data signal. Wall charges enough to cause the discharge are formed when the sustain voltage (Vs) is applied within cells selected by the address discharge. A positive polarity voltage (Vz) is supplied to the sustain electrode to prevent mis-discharge from generating between the sustain electrode and the scan electrode by decreasing the voltage difference from the scan electrode during the setdown period and the address period.

At the sustain period, sustain signals (Sus) are alternatively applied to the scan electrode and the sustain electrodes. A cell selected by the address discharge generates the sustain discharge, that is, display discharge between the scan electrode and the sustain electrode whenever each sustain signal is applied while a sustain signal is added to the wall voltage within the cell.

At the eraser period, after the sustain discharge is completed, a voltage of ramp-ers having small pulse width and voltage level is supplied to the sustain electrode to erase wall charges remaining within cells of an entire screen.

A conventional plasma display apparatus for generating and supplying the driving waveform will be described with reference to FIG. 4.

FIG. 4 is a circuit diagram of the conventional plasma display apparatus. As shown in the figure, the conventional plasma display apparatus includes a sustain voltage supply unit 40, a setup supply unit 41, a scan voltage supply unit 42, a driving signal output unit 43, a setdown supply unit 44, a negative polarity scan voltage supply unit 45, a seventh switch (Q7) connected between the setup supply unit 41 and the driving signal output unit 43, and a sixth switch (Q6) connected between the setup supply unit 41 and the sustain voltage supply unit 40.

The driving signal output unit 43 is connected in a push-pull type and is composed of a twelfth and a thirteenth switch (Q12, Q13) for inputting a voltage signal from the sustain voltage supply unit 40, the setup supply unit 41, the scan voltage supply unit 42, the setdown supply unit 44, and the negative polarity scan voltage supply unit 45. An output line between the twelfth and the thirteenth switch (Q12, Q13) is connected to the panel (Cp), preferably to one of scan electrode lines of the panel (Cp).

The sustain voltage supply unit 40 includes a energy supply and recovery capacitor (C1) for charging energy recovered from the panel (Cp), an inductor (L1) connected between the energy supply and recovery capacitor (C1) and a drive integrated circuit 43, and a first switch (Q1), a first diode (D1), a second switch (Q2), and a second diode (D2) connected in parallel between the inductor (L1) and the energy supply and recovery capacitor (C1). The sustain voltage supply unit 40 decreases excessive consumption power at the discharge during the setup period and the sustain period by supplying a voltage to the panel (Cp) using the recovered energy after recovering an energy from the panel (Cp).

The scan voltage supply unit 42 includes a third capacitor (C3) connected between a scan voltage source (Vsc) and a second node (n2) and an eighth switch (Q8) and a ninth switch (Q9) connected between the scan voltage source (Vsc) and the second node (n2). While the eighth switch (Q8) and the ninth switch (Q9) are switched by a control signal supplied from a timing controller during the address period, they supply a voltage of the scan voltage source (Vsc) to the drive integrated circuit 43. The third capacitor (C3) adds a voltage of the scan voltage source (Vsc) to a voltage applied to the second node (n2) and thus supplies the sum voltage to the eighth switch (Q8).

The setup supply unit 41 includes a third diode (D3) and a fifth switch (Q5) connected between the setup voltage source (Vst) and the first node (n1) and a second capacitor (C2) provided between the setup voltage source (Vst) and the sustain voltage supply unit 40. The third diode (D3) intercepts a backward current flowing from the second capacitor (C2) toward the setup voltage source (Vst). The second capacitor (C2) adds a voltage of the setup voltage source (Vst) to the sustain voltage (Vs) supplied from the sustain voltage supply unit 40 and thus supplies the sum voltage to the fifth switch (Q5). The fifth switch (Q5) is switched by responding to a control signal that is not shown during the reset period and thus supplies the setup voltage to the first node (n1).

The setdown supply unit 44 includes a tenth switch (Q10) connected between the second node (n2) and a negative polarity scan voltage (−Vy). The setdown supply unit 44 slowly falls a voltage supplied from the driving signal output unit 43 during the setdown period included in the reset period to a negative polarity scan voltage (−Vy) in a predetermined slope. Here, the negative polarity scan voltage (−Vy) is used as the setdown power source.

The negative polarity scan voltage supply unit 45 includes an eleventh switch (Q11) connected between the second node (n2) and the negative polarity scan voltage source (−Vy). The eleventh switch (Q11) is switched by responding to a control signal supplied from the timing controller which is not shown during the address period and thus supplies the negative polarity scan voltage (−Vy) to the driving signal output unit 43.

A process of generating a reset waveform of the reset period among driving waveforms shown in FIG. 3 in a conventional driving apparatus of the plasma display panel will be described with reference to FIG. 5.

FIG. 5 is a timing chart illustrating a switching operation for generating a ramp-up waveform at the reset period in the driving apparatus of the conventional plasma display panel. Here, it is supposed that a voltage (Vst) of a setup voltage source is charged in the second capacitor (C2).

First, during the setup period, the fifth switch (Q5) and the seventh switch (Q7) are turned-on and the sixth switch (Q6) and the tenth switch (Q10) are turned-off. At this time, the sustain voltage (Vs) is supplied from the sustain voltage supply unit 40. The sustain voltage (Vs) supplied from the sustain voltage supply unit 40 is supplied to the panel (Cp) via an inside diode of the sixth switch (Q6), the seventh switch (Q7), and the driving signal output unit 43. Therefore, a voltage of the panel (Cp) is rapidly raised to a voltage Vs.

On the other hand, the setup voltage (Vst) stored in the second capacitor (C2) is added to the voltage (Vs) of a sustain voltage source and thus the sum voltage is supplied to the fifth switch (Q5). While the fifth switch (Q5) adjusts a channel width by a first variable resistor (VR1) provided in the front terminal thereof, it supplies a voltage supplied from the second capacitor (C2) to the first node (n1) in a predetermined slope. A voltage applied to the first node (n1) in a predetermined slope is supplied to the panel (Cp) via the seventh switch (Q7) and the driving signal output unit 43. At this time, a ramp-up waveform is supplied to the panel (Cp).

After the ramp-up waveform is supplied to the panel (Cp), the fifth switch (Q5) is turned-off. When the fifth switch (Q5) is turned-off, only a voltage Vs supplied from the sustain voltage supply unit 40 is applied to the first node (n1), so that the voltage of panel (Cp) rapidly falls to a voltage Vs.

The setup supply unit 41 supplies the ramp-up waveform to the panel (Cp) during the reset period while repeating such a process.

There is a problem in that the conventional driving apparatus of the plasma display panel has the relatively expensive production cost. For example, the production cost is increased by using the sixth switch (Q6) having a high dielectric strength. That is, the sixth switch (Q6) performs a role of adding the sustain voltage Vs to the voltage Vst of the setup voltage source, but because it is positioned in a path to which the sustain pulse is supplied, it should be a high-capacity switching element having a high dielectric strength. Therefore, there is a problem in that the production cost is increased.

Further, a driving waveform in which the conventional plasma display panel generates may deteriorate a driving efficiency because a voltage of the reset period waveform is relatively low. That is, recently, a content of Xenon (Xe) within a discharge cell of the plasma display panel is increased, so that a discharge start voltage is increased. For example, on the assumption that the discharge generates in a voltage of 100V in previous case, if a content of Xenon (Xe) is increased, the discharge generates in a voltage of 150V. In this case, if a reset waveform of a conventional driving waveform is applied, reset discharge is unstable, so that a driving efficiency is decreased.

SUMMARY OF THE INVENTION

Accordingly, an object of the present invention is to solve at least the problems and disadvantages of the background art.

An object of the present invention is to provide a plasma display apparatus which can reduce the production cost.

Another object of the present invention is to provide a plasma display apparatus which can improve a driving efficiency by improving a setup waveform at a reset period.

To achieve these and other advantages and in accordance with the purpose of the present invention, as embodied and broadly described, there is provided a plasma display apparatus comprising: a plasma display panel including electrodes; a first voltage supply unit supplying a first voltage to the electrodes at a setup period; and a setup/scan operation unit supplying a ramp-up pulse to the electrodes at the setup period with one voltage source and supplying a second voltage to the electrodes at the address period with the one voltage source.

According to another aspect of the present invention, there is provided a driving method of a plasma display apparatus, the method comprising: applying a first voltage to electrodes; and applying a ramp-up pulse rising from the first voltage to a sum of the first voltage and the second voltage using when scanning the electrodes to the electrodes.

According to another aspect of the present invention, there is provided a driving apparatus of a plasma display panel comprising: a plasma display panel including electrodes; a first voltage supply unit supplying a first voltage; a first setup supply unit supplying a first ramp-up pulse rising from the first voltage to a first sum voltage corresponding to a sum of the first voltage and the second voltage to the electrodes; and a second setup supply unit supplying a second ramp-up pulse rising to a second sum voltage corresponding to a sum of the first voltage, the second voltage, and the third voltage to the electrodes after the first ramp-up pulse is applied and supplying the third voltage to the electrodes when scanning the electrodes.

According to another aspect of the present invention, there is provided a driving method of a plasma display apparatus, the method comprising: applying a first voltage to the electrodes; applying a first ramp-up pulse rising from the first voltage to a first sum voltage corresponding to a sum of the first voltage and a second voltage to the electrodes; and applying a second ramp-up pulse rising to a second sum voltage corresponding to a sum of the first voltage, the second voltage, and a third voltage supplied when scanning the electrodes to the electrodes after the ramp-up pulse is applied.

According to another aspect of the present invention, there is provided a plasma display apparatus comprising: a plasma display panel including electrodes; a first voltage supply unit supplying a first voltage to the electrodes; a second voltage supply unit generating a ramp-up pulse rising from the first voltage to a sum of the first voltage and the second voltage; and a third voltage supply unit supplying the result in which the third voltage using when scanning the electrodes is added to the ramp-up pulse to the electrodes.

According to another aspect of the present invention, there is provided a driving method of a plasma display apparatus including electrodes, the method comprising: applying a first voltage to the electrodes; generating a ramp-up pulse rising from the first voltage to a sum of the first voltage and a second voltage when the first voltage is applied; and applying the result in which the ramp-up pulse is added to a third voltage to the electrodes.

According to the present invention, it is possible to decrease the production cost by reducing the number of components and improve a driving efficiency by raising a voltage of a setup waveform at a reset period.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
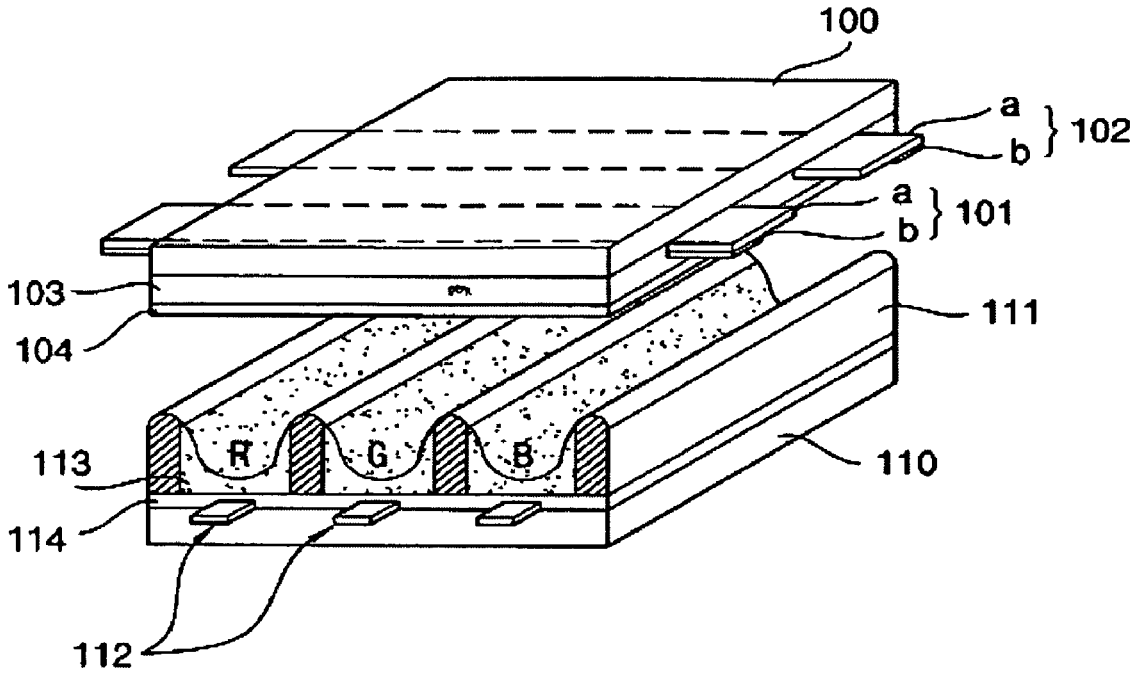
FIG. 1 is a perspective view of general plasma display panel.
Figure 2:
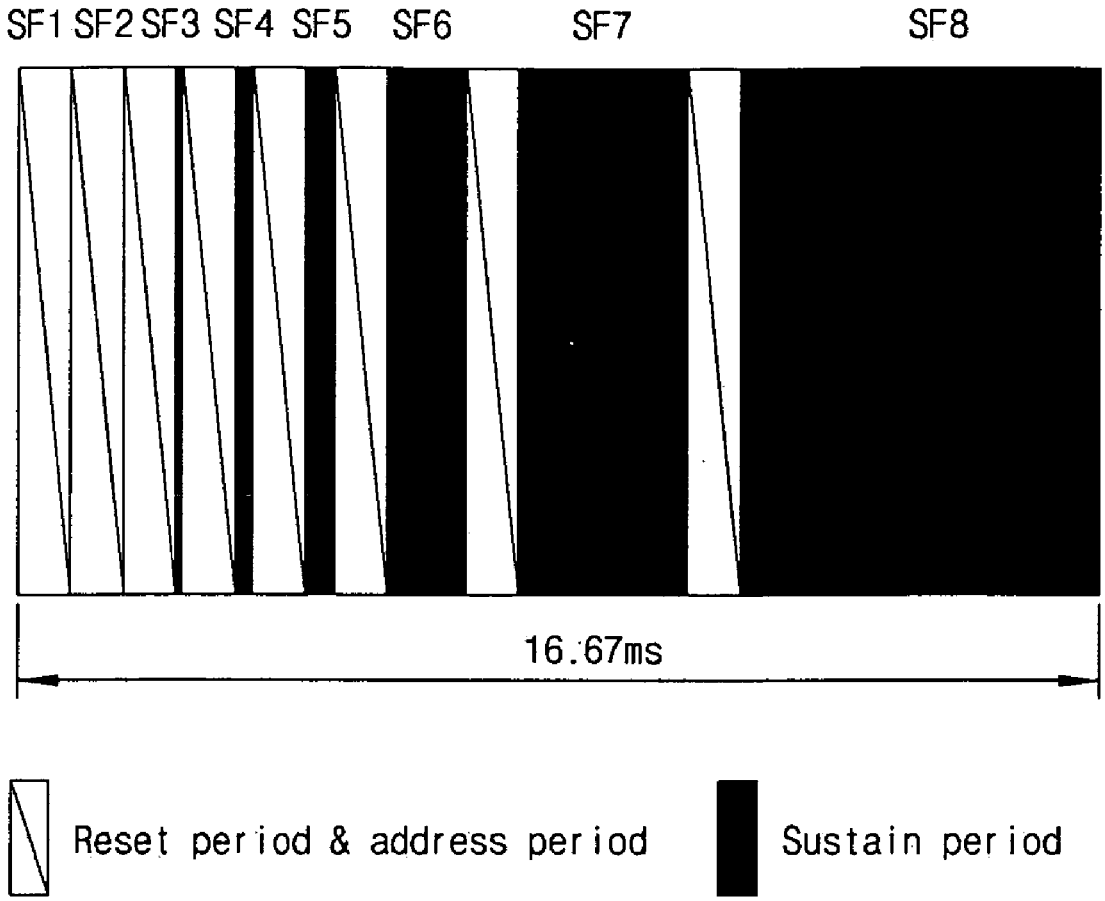
FIG. 2 is a diagram illustrating a method of embodying an image gray level of a conventional plasma display apparatus.
Figure 3:
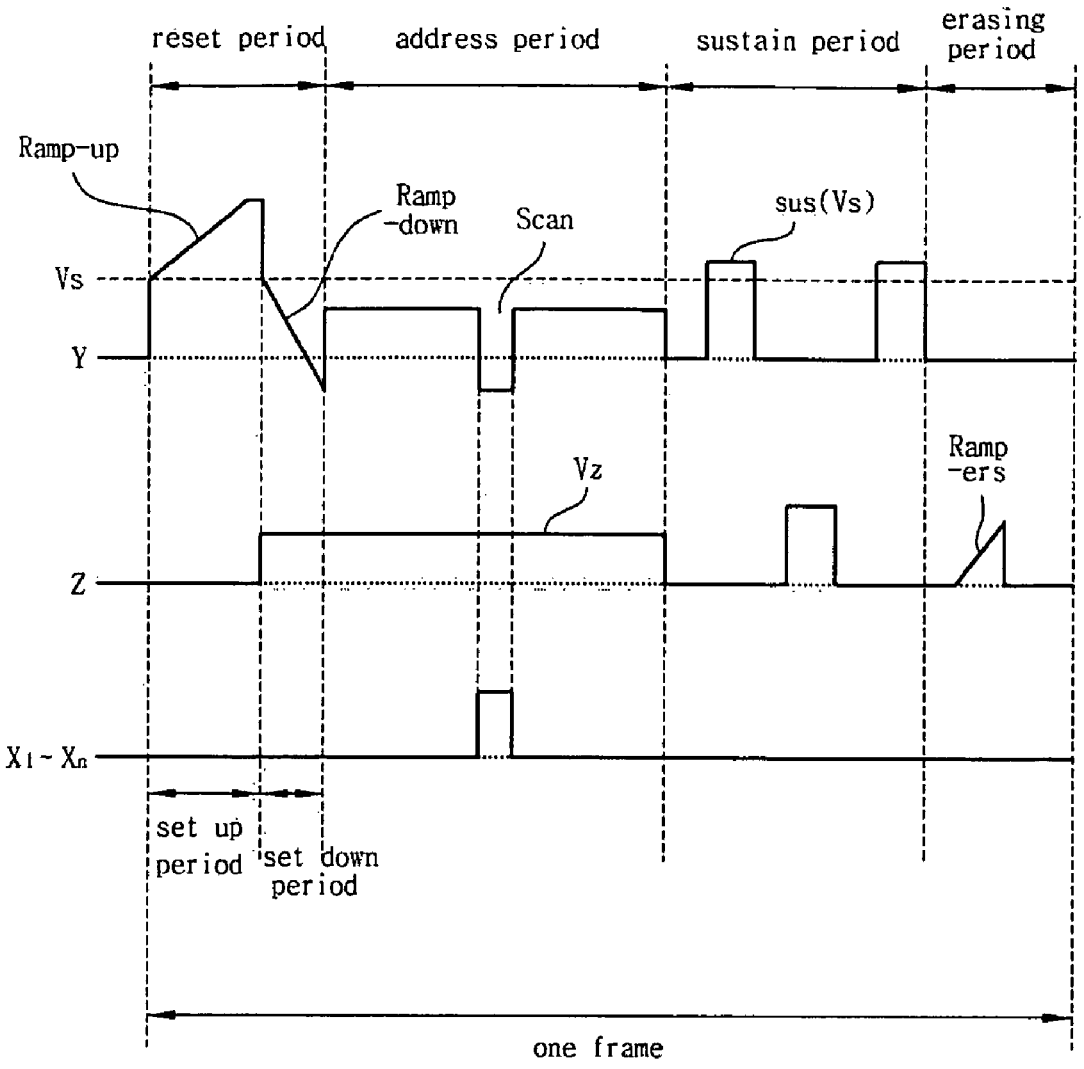
FIG. 3 is a diagram illustrating driving waveforms according to a driving method of the conventional plasma display apparatus.

Preferred embodiments of the present invention will be described in a more detailed manner with reference to the drawings.

A plasma display apparatus according to the present invention includes a plasma display panel including electrodes; a first voltage supply unit supplying a first voltage to the electrodes at a setup period; and a setup/scan operation unit supplying a ramp-up pulse to the electrodes at the setup period with one voltage source and supplying a second voltage to the electrodes at the address period with the one voltage source.

The setup/scan operation unit may include a second voltage storage unit storing the second voltage and supplying a sum voltage corresponding to a sum of the first voltage and the second voltage when the first voltage is applied; and a ramp-up generating unit generating the ramp-up pulse rising from the first voltage to the sum voltage when the sum voltage is supplied by the second voltage storage unit.

The second voltage storage unit may be provided with one terminal connected to the ramp-up generating unit and the other terminal receiving the first voltage; the ramp-up generating unit is provided with one terminal receiving the second voltage and connected to one terminal of the second voltage storage unit and the other terminal applying the ramp-up pulse to the electrodes.

The ramp-up generator may include a variable resistor and a switch consisting of a transistor, and the variable resistor is connected to a gate terminal of the transistor.

The plasma display apparatus may further include a driving signal output unit supplying a pulse for driving the electrodes, wherein the driving signal output unit includes a upper switch and a lower switch which are connected in series to each other, the upper switch supplies the ramp-up pulse to the electrodes.

A driving method of a plasma display apparatus, the method may include applying a first voltage to the electrodes; and applying a ramp-up pulse rising from the first voltage to a sum of the first voltage and the second voltage using when scanning of the electrodes to the electrodes.

The first voltage may be a sustain voltage for sustaining sustain discharge.

A driving apparatus of a plasma display panel according to the present invention includes a plasma display panel including electrodes; a first voltage supply unit supplying a first voltage; a first setup supply unit supplying a first ramp-up pulse rising from the first voltage to a first sum voltage corresponding to a sum of the first voltage and the second voltage to the electrodes; and a second setup supply unit supplying a second ramp-up pulse rising to a second sum voltage corresponding to a sum of the first voltage, the second voltage, and the third voltage to the electrodes after the first ramp-up pulse is applied and a second setup supply unit supplying the third voltage to the electrodes when scanning the electrodes.

The second setup supply unit may include a third voltage storage unit storing the third voltage and supplying the second sum voltage when the first sum voltage is applied; and a second ramp-up generator generating a second ramp-up pulse rising from the first sum voltage to the second sum voltage when the second sum voltage is supplied by the third voltage storage unit.

The third voltage storage unit may be provided with one terminal connected to the second ramp-up generating unit and the other terminal receiving the first sum voltage; and the second ramp-up generating unit is provided with one terminal receiving the third voltage and connected to one terminal of the third voltage storage unit and the other terminal applying the second ramp-up pulse.

The second ramp-up generator may include a variable resistor and a switch consisting of a transistor, and the variable resistor is connected to a gate terminal of the transistor.

A driving method of a plasma display apparatus, the method includes applying a first voltage to the electrodes; applying a first ramp-up pulse rising from the first voltage to a first sum voltage corresponding to a sum of the first voltage and a second voltage to the electrodes; and applying a second ramp-up pulse rising to a second sum voltage corresponding to a sum of the first voltage, the second voltage, and a third voltage supplied when scanning the electrodes to the electrodes after the ramp-up pulse is applied.

The first ramp-up pulse and the second ramp-up pulse may have the same slope.

The first voltage may be a sustain voltage forming sustain discharge.

A plasma display panel apparatus includes a plasma display panel including electrodes; a first voltage supply unit supplying a first voltage to the electrodes; a second voltage supply unit generating a ramp-up pulse rising from the first voltage to a sum of the first voltage and the second voltage; and a third voltage supply unit supplying the result in which the third voltage using when scanning the electrodes is added to the ramp-up pulse to the electrodes.

The third voltage supply unit may include a third voltage storage unit storing the third voltage and supplying the result in which the third voltage is added to the ramp-up pulse when the ramp-up pulse is generated.

The third voltage supply unit may further include a third voltage supply control unit controlling the result supplied by the third voltage storage unit to be applied to the electrodes.

The third voltage storage unit may be provided with one terminal connected to the third voltage to apply the result to the electrodes and the other terminal receiving the ramp-up pulse.

The third voltage supply control unit may be provided with one terminal receiving the third voltage and connected to one terminal of the third voltage storage unit and the other terminal applying the result to the electrodes.

A driving method of a plasma display apparatus, the method includes applying a first voltage to the electrodes; generating a ramp-up pulse rising from the first voltage to a sum of the first voltage and a second voltage when the first voltage is applied; and applying the result in which the ramp-up pulse is added to a third voltage to the electrodes.

The first voltage may be a sustain voltage forming sustain discharge.

Hereinafter, exemplary embodiments according to the present invention will be described with reference to the attached drawings.

The First Embodiment

Figure 6:
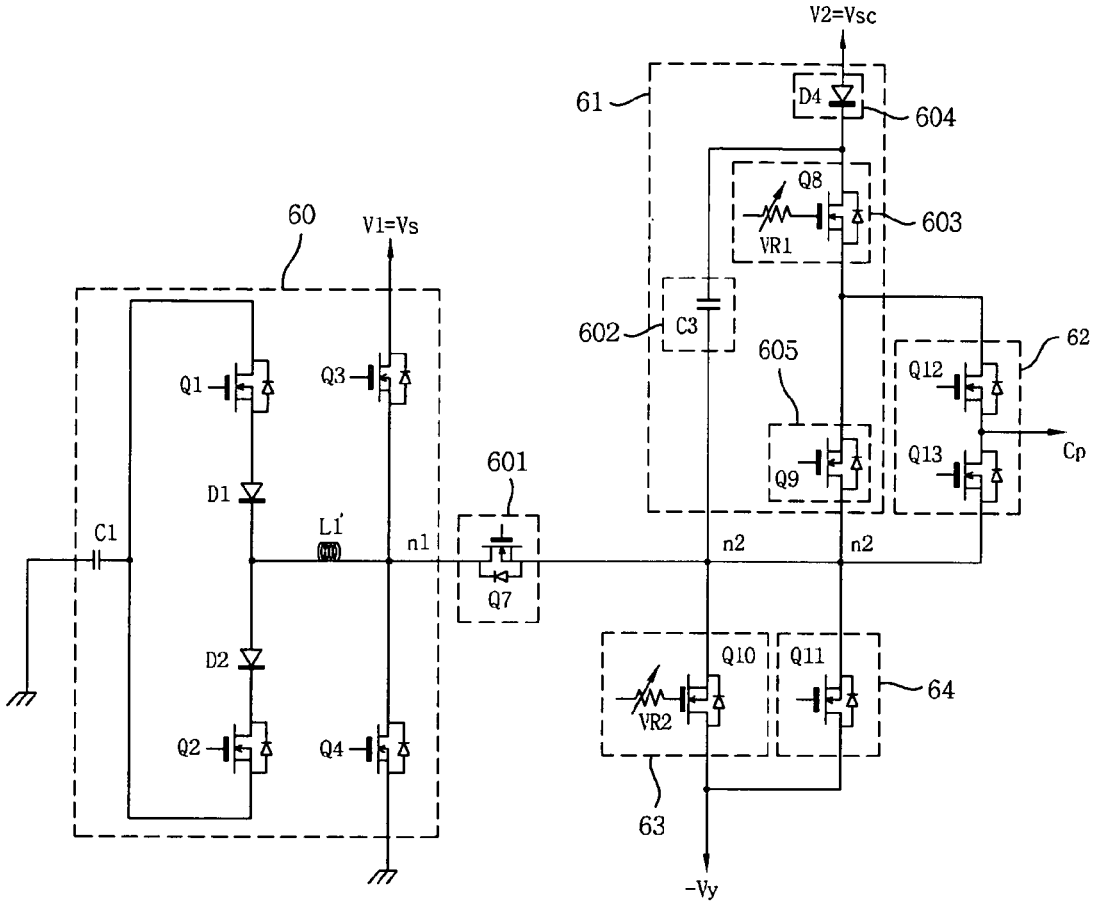
FIG. 6 is a circuit diagram of a plasma display apparatus according to a first embodiment of the present invention.

FIG. 6 is a circuit diagram of a plasma display apparatus according to a first embodiment of the present invention. As shown in the figure, the first embodiment of a driving apparatus of a plasma display panel according to the present invention includes a first voltage supply unit 60, a setup/scan operation unit 61, a driving signal output unit 62, a setdown supply unit 63, and a negative polarity voltage supply unit 64. Reference number 601 indicates a current path control unit which includes a seventh switch (Q7) for controlling a current path.

A driving signal output unit 62 is connected in a push-pull type and is composed of a twelfth switch (Q12) and a thirteenth switch (Q13) for inputting a voltage signal from the first voltage supply unit 60, the setup/scan operation unit 61, and the setdown supply unit 63, and the negative polarity voltage supply unit 64. An output line between the twelfth switch (Q12) and the thirteenth switch (Q13) is connected to a panel (Cp), preferably to one of scan line electrodes of the panel (Cp).

The first voltage supply unit 60 includes an energy supply and recovery capacitor (C1) for charging energy recovered from the panel (Cp), an inductor (L1) connected between the energy supply and recovery capacitor (C1) and the driving signal output unit 62, and a first switch (Q1), a first diode (D1), a second switch (Q2), and a second diode (D2) connected in parallel between the inductor (L1) and the energy supply and recovery capacitor (C1).

The setup/scan operation unit 61 includes a second voltage storage unit 602 connected between a scan voltage source (V2=Vsc) that is a second voltage and the second node (n2), a ramp-up generator 603 and a current path selection control unit 605 connected between the scan voltage source (V2=Vsc) and the second node (n2), and a countercurrent interceptor 604 connected between the scan voltage source (V2=Vsc) and the second voltage storage unit 602 or the ramp-up generator 603.

A current path selection control unit 605 includes a ninth switch (Q9).

The countercurrent interceptor 604 includes a fourth diode (D4) and is provided to intercept a backward current flowing from the second voltage storage unit 602 toward the scan voltage source (Vsc).

The second voltage storage unit 602 includes a capacitor (C3) for storing a scan voltage and supplies a sum voltage of a voltage of the scan voltage source (Vsc) that has been previously stored in the capacitor (C3) for storing a scan voltage and a sustain voltage (Vs) supplied from the first voltage supply unit 60 to the ramp-up generator 603. That is, a voltage (Vsc+Vs) is supplied to the ramp-up generator 603.

The ramp-up generator 603 includes an eighth switch (Q8) in which the first variable resistor (VR1) is connected to a gate terminal and forms the ramp-up in a predetermined slope. Further, the ramp-up generator 603 is switched by responding to a control signal that is not shown during a reset period and thus supplies a setup voltage to the panel (Cp) through a driving signal output unit 62. Further, the eighth switch (Q8) of the ramp-up generator 603 and the ninth switch (Q9) of the current path selection control unit 605 supply a voltage of the scan voltage source (V2=Vsc) to the driving signal output unit 62 while switching by a control signal that is supplied from a timing controller (not shown) during the address period.

Here, one terminal of the second voltage storage unit 602 is commonly connected to one terminal of the driving signal output unit 62, one terminal of the first voltage supply unit 60, and one terminal of the current path selection unit 605, and the other terminal thereof is commonly connected to one terminal of the countercurrent interceptor 604 and one terminal of the ramp-up generator 603.

Further, the other terminal of the ramp-up generator 603 is commonly connected to the other terminal of the current path selection control unit and the other terminal of the driving signal output unit 62.

The setdown supply unit 63 includes a tenth switch (Q10) connected between the second node (n2) and a negative polarity voltage source (−Vy). Here, a predetermined variable resistor (VR2) is attached to a gate terminal of the tenth switch (Q10). The setdown supply unit 63 slowly falls a voltage supplied to the driving signal output unit 62 to a negative polarity voltage (−Vy) in a predetermined slope during the setdown period included at the reset period. Here, the negative polarity voltage (−Vy) is used as a setdown voltage source.

The negative polarity voltage supply unit 64 includes an eleventh switch (Q11) connected between the second node (n2) and the negative polarity voltage source (−Vy). The eleventh switch (Q11) is switched by responding to a control signal supplied from the timing controller which is not shown during the address period and thus supplies the negative polarity voltage (−Vy) to the driving signal output unit 62.

A process of generating a reset waveform of the reset period in a driving apparatus of a plasma display panel according to the present invention will be described with reference to FIG. 7.

Figure 7:
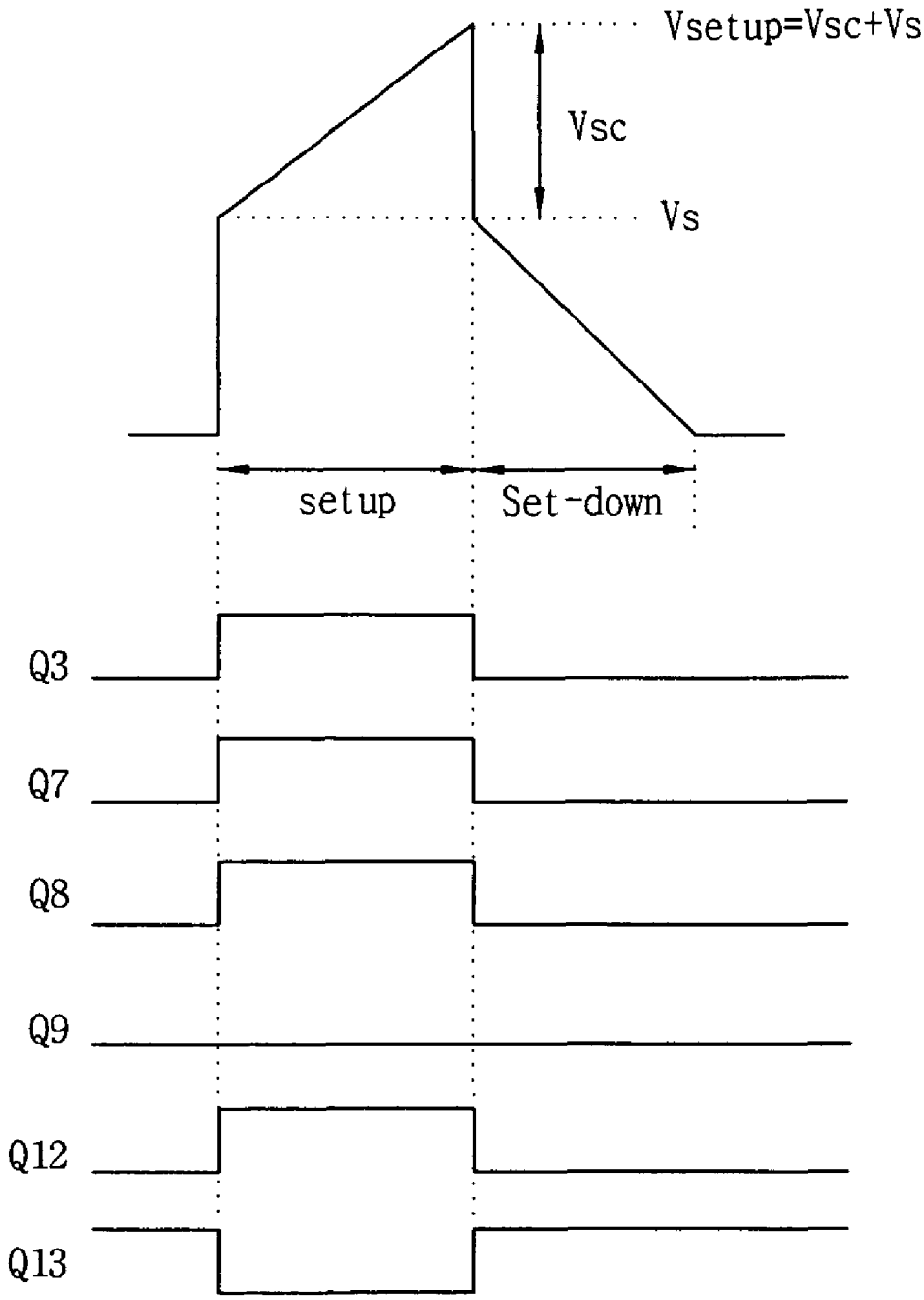
FIG. 7 is a timing chart illustrating driving waveforms and switch timing according to an operation of the first embodiment of the present invention.

FIG. 7 is a timing chart illustrating driving waveforms and switch timing according to an operation of the first embodiment of the present invention.

It is supposed that a scan voltage (V2=Vsc) is charged in the second voltage storage unit 602. First, during a setup period, the third switch (Q3) of the first voltage supply unit 60, the seventh switch (Q7) of the current path control unit 601, the eighth switch (Q8) of the ramp-up generator 603, and the twelfth switch (Q12) of the driving signal output unit 62 are turned-on, the ninth switch (Q9) of the current path selection control unit 605 sustains a turn-off state, and a thirteenth switch (Q13) of the driving signal output unit 62 is turned-off.

At this time, the sustain voltage (V1=Vs) that is the first voltage from the first voltage supply unit 60 is supplied. The sustain voltage (V1=Vs) supplied from the first voltage supply unit 60 is supplied to the second voltage storage unit 602 through the seventh switch (Q7) of the current path control unit 601. A voltage of the second node (n2) becomes the sustain voltage (V1=Vs).

Accordingly, the second voltage storage unit 602 adds a voltage Vs received through the seventh switch (Q7) of the current path control unit 601 to the scan voltage (V2=Vsc) that has been previously stored and then supplies the sum voltage to the ramp-up generator 603. That is, the voltage (Vs+Vsc) is supplied to the ramp-up generator 603.

While the ramp-up generator 603 adjusts a channel width with the variable resistor (VR1) provided in a gate terminal of the eighth switch (Q8), a signal applied to the ramp-up generator 603 is supplied to the driving signal output unit 62 in a predetermined slope. A voltage applied in a predetermined slope to the driving signal output unit 62 and is supplied to the panel (Cp) via the twelfth switch (Q12). At this time, a ramp-up waveform is supplied to the panel (Cp).

The setup/scan operation unit 61 supplies a ramp-up waveform to the panel (Cp) during the reset period while repeating such a process.

Figure 4:
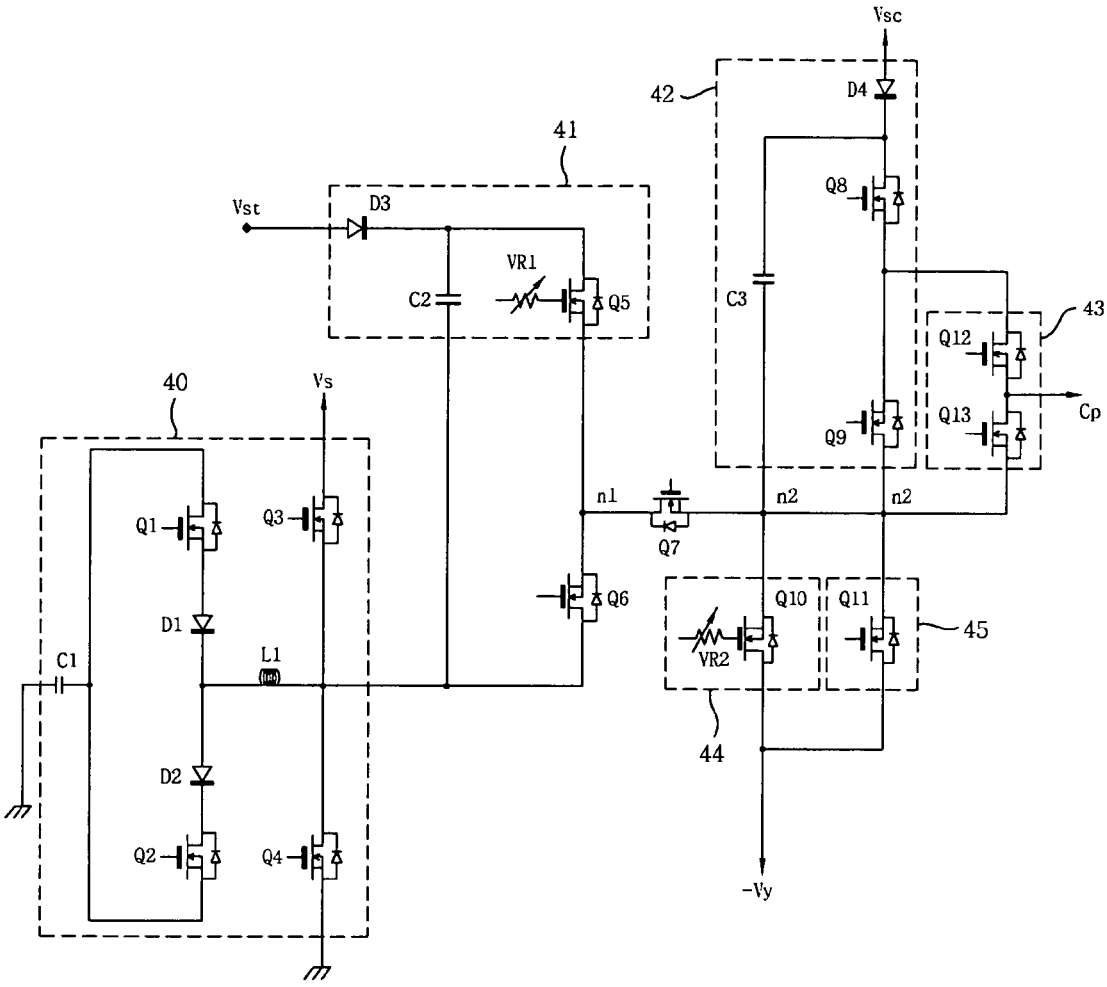
FIG. 4 is a circuit diagram of the conventional plasma display apparatus.
Figure 5:
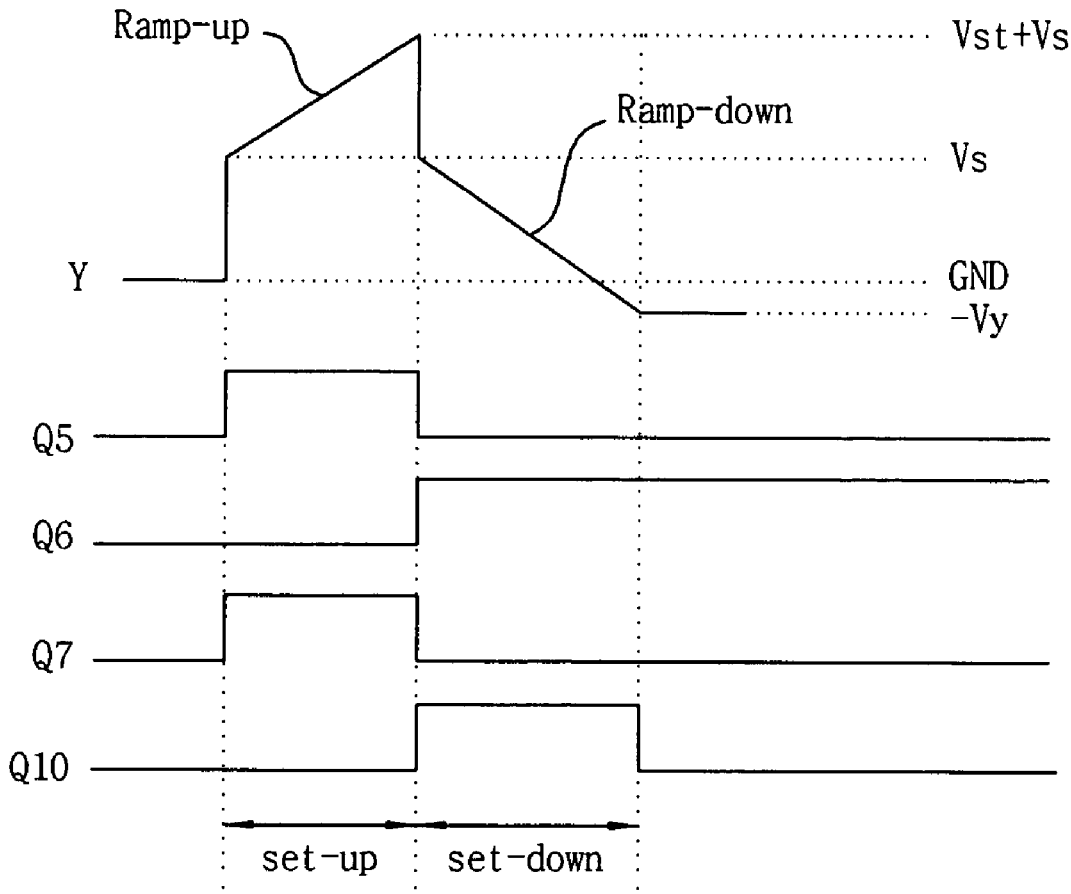
FIG. 5 is a timing chart illustrating a switching operation for generating a ramp-up waveform at a reset period in a driving apparatus of the conventional plasma display panel.

In this way, the first embodiment of the plasma display apparatus according to the present invention performs a normal reset operation by generating a ramp-up waveform and applying it to the panel (Cp) during the reset period although the sixth switch (Q6) having a high-capacity to pass a sustain current is omitted, compared to a case of FIG. 4. Further, a circuit occupying area is reduced and the production cost is decreased because the third diode (D3), the second capacitor (C2), and the fifth switch (Q5) are omitted, compared to a case of FIG. 4.

The Second Embodiment

Figure 8:
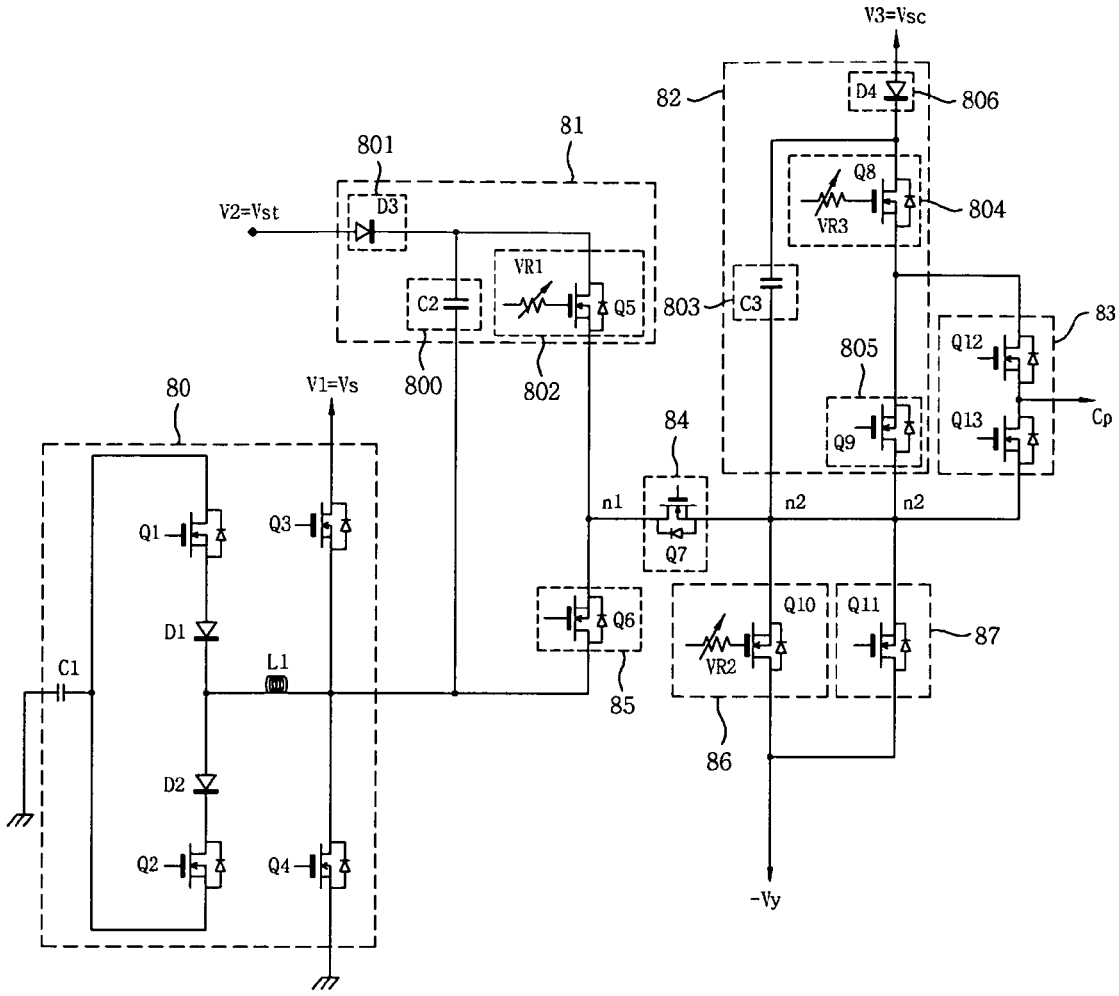
FIG. 8 is a circuit diagram of a second embodiment of a plasma display apparatus according to the present invention.

FIG. 8 is a circuit diagram of a second embodiment of the driving apparatus of the plasma display panel according to the present invention. As shown in the figure, the other embodiment of the driving apparatus of the plasma display panel according to the present invention includes a first voltage supply unit 80, a first setup supply unit 81, a second setup supply unit 82, a driving signal output unit 83, a setdown supply unit 86, a negative polarity scan voltage supply unit 87, a first current path control unit 84 connected between the first setup supply unit 81 and the driving signal output unit 83, and a second current path control unit 85 connected between the first setup supply unit 81 and the first voltage supply unit 80.

The first setup supply unit 81 includes a first countercurrent interceptor 801 and the first ramp-up generator 802 connected between the first node (n1) and a setup voltage source (V2=Vst) supplying a setup voltage that is a second voltage and the second voltage storage unit 800 provided between an energy recovery circuit 80 and the setup voltage source (V2=Vst).

The first countercurrent interceptor 801 includes the third diode (D3) and intercepts a backward current flowing from the second voltage storage unit 800 toward the setup voltage source (V2=Vst).

The second voltage storage unit 800 includes the second capacitor (C2) and supplies a sum of the setup voltage source (V2=Vst) and the sustain voltage (V1=Vs) that is the first voltage supplied from the energy recovery circuit 80 to the first ramp-up generator 802.

The first ramp-up generator 802 includes a fifth switch (Q5), but the first variable resistor (VR1) is attached to a gate terminal of the fifth switch (Q5). Further, the fifth switch (Q5) of the first ramp-up generator 802 is switched by responding to a control signal that is not shown during the reset period and supplies a setup voltage to the first node (n1).

The second setup supply unit 82 includes the third voltage storage unit 803 connected between the scan voltage source (V3=Vsc) supplying the scan voltage that is the third voltage and the second node (n2), the second ramp-up generator 804 and the current path selection control unit 805 connected between the scan voltage source (Vsc) and the second node (n2), and the second countercurrent interceptor 806 connected between the scan voltage source (Vsc) and the second ramp-up generator 804 or the third voltage storage unit 803.

The current path selection control unit 805 includes the ninth switch (Q9).

The second countercurrent interceptor 806 includes the fourth diode (D4) and is provided to intercept a backward current flowing from the third voltage storage unit 803 toward the scan voltage source (V3=Vsc).

The third voltage storage unit 803 includes the third capacitor (C3) for storing the scan voltage (V3=Vsc) that is the third voltage, and one terminal of the third voltage storage unit 803 is commonly connected to one terminal of the driving signal output unit 83, one terminal of the first current path control unit 84, and one terminal of the current path selection control unit 805, and the other terminal thereof is commonly connected to one terminal of the second countercurrent interceptor 806 and one terminal of the second ramp-up generator 804. Further, the third voltage storage unit 803 includes a capacitor (C3) for storing the scan voltage (V3=Vsc) and supplies a sum voltage of a voltage supplied through the first ramp-up generator 802 and the scan voltage (V3=Vsc) which has been previously stored to the capacitor (C3) for storing the scan voltage (V3=Vsc) to the second ramp-up generator 804 during the reset period. That is, a voltage Vs+Vsc+Vst is supplied to the second ramp-up generator 804.

The other terminal of the second ramp-up generator 804 is commonly connected to the other terminal of the current path selection control unit 805 and the other terminal of the driving signal output unit 83. Further, the second ramp-up generator 804 includes the eighth switch (Q8), but the second variable resistor (VR2) is provided in the gate terminal of the eighth switch (Q8). Here, the eighth switch (Q8) of the second ramp-up generator 804 is turned-on and transmits a setup voltage to the panel (Cp) during a second setup period of the reset period. Further, while the eighth switch (Q8) and the ninth switch (Q9) of the current path selection control unit 805 are switched by a control signal supplied from a timing controller during the address period, they supply a voltage of the scan voltage source (V3=Vsc) to the driving signal output unit 83.

A process of generating a reset waveform of the reset period in a driving apparatus of the plasma display panel of the present invention will be described with reference to FIG. 9.

Figure 9:
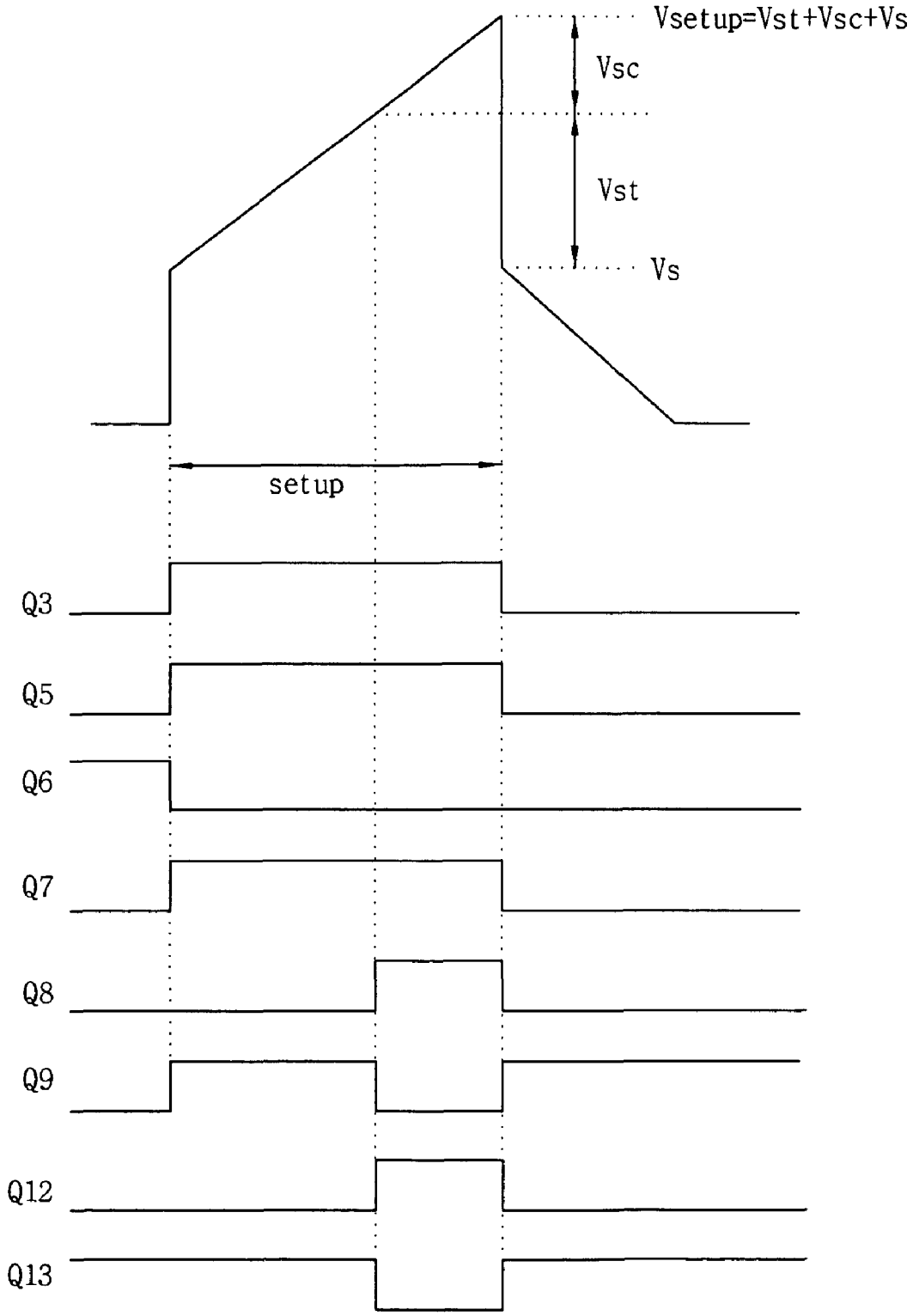
FIG. 9 is a timing chart illustrating driving waveforms and switch timing according to an operation of the second embodiment of the present invention.

FIG. 9 is a timing chart illustrating driving waveforms and switch timing according to an operation of the second embodiment of the present invention. It is supposed that the voltage (V2=Vst) of the setup voltage source is charged in the second capacitor (C2) of the second voltage storage unit 800 and the voltage (V3=Vsc) of the scan voltage source is charged in the third capacitor (C3) of the third voltage storage unit 803.

First, the third switch (Q3) of the first voltage supply unit 80, the fifth switch (Q5) of the first ramp-up generator 802, the seventh switch (Q7) of the first current path control unit 84, and the ninth switch (Q9) of the current path selection control unit 805 are turned-on during the first setup period of the reset period. Further, a thirteenth switch (Q13) of the driving signal output unit 83 continuously maintains a turn-on state, the sixth switch (Q6) of the second current path control unit 85 is turned-off, and the eighth switch (Q8) of the second ramp-up generator 804 and the twelfth switch (Q12) of the driving signal output unit 83 continuously maintain a turn-off state. The sustain voltage (V1=Vs) that is the first voltage from the first voltage supply unit 80 is supplied. The sustain voltage (V1=Vs) that is supplied from the first voltage supply unit 80 is supplied to the panel (Cp) via an inside diode of the sixth switch (Q6), the seventh switch (Q7), and the thirteenth switch (Q13) of the driving signal output unit 83. Therefore, a voltage of panel (Cp) is rapidly raised to the voltage Vs.

On the other hand, the setup voltage (V2=Vst) stored in the second capacitor (C2) of the second voltage storage unit 800 is added to the voltage (V1=Vs) of the sustain voltage source and then the sum voltage is supplied to the fifth switch (Q5) of the first ramp-up generator 802. While the first ramp-up generator 802 adjusts a channel width with the first variable resistor (VR1) provided in a gate terminal of the fifth switch (Q5), it supplies a voltage supplied from the second capacitor (C2) of the second voltage storage unit 800 to the first node (n1) in a predetermined slope. The voltage applied to the first node (n1) in a predetermined slope is supplied to the panel (Cp) via the seventh switch (Q7) and the thirteenth switch (Q11) of the driving signal output unit 83. At this time, the first ramp-up pulse (Ramp-up) is supplied to the panel (Cp).

After the first ramp-up pulse is applied, after a voltage applied to the panel (Cp) is raised to the voltage (Vs+Vst), the eighth switch (Q8) of the second ramp-up generator 804 and the twelfth switch (Q12) of the driving signal output unit 83 are turned-on and the ninth switch (Q9) and the thirteenth switch (Q13) are turned-off. At this time, a voltage of the second node (n2) becomes the voltage (Vs+Vst). Accordingly, the voltage (V3=Vsc) of the scan voltage source voltage stored in the third capacitor (C3) of the third voltage storage unit 803 is added to the voltage (Vs+Vst) and then the sum voltage is supplied to the second ramp-up generator 804. While the second ramp-up generator 804 adjusts a channel width with the second variable resistor (VR2) provided in the gate terminal of the eighth switch (Q8), it supplies the second ramp-up pulse having a predetermined slope to the driving signal output unit 83 using a voltage (Vs+Vst+Vsc) supplied from the third capacitor (C3) of the third voltage storage unit 803.

While the first setup supply unit 81 and the second setup supply unit 82 repeats such a process, they supply the first ramp-up pulse and the second ramp-up pulse to the panel (Cp) during the reset period. At this time, it is preferable that slopes of the first ramp-up pulse of the first setup period and the second ramp-up pulse of the second setup period are the same. That is, the first ramp-up generator 802 and the second ramp-up generator 804 adjust a channel width in the same change amount and thus generate the first ramp-up pulse and the second ramp-up pulse having the same slope.

Accordingly, the reset voltage is further raised and thus a more efficient reset operation is performed, so that a drive efficiency is improved when driven.

The Third Embodiment

Figure 10:
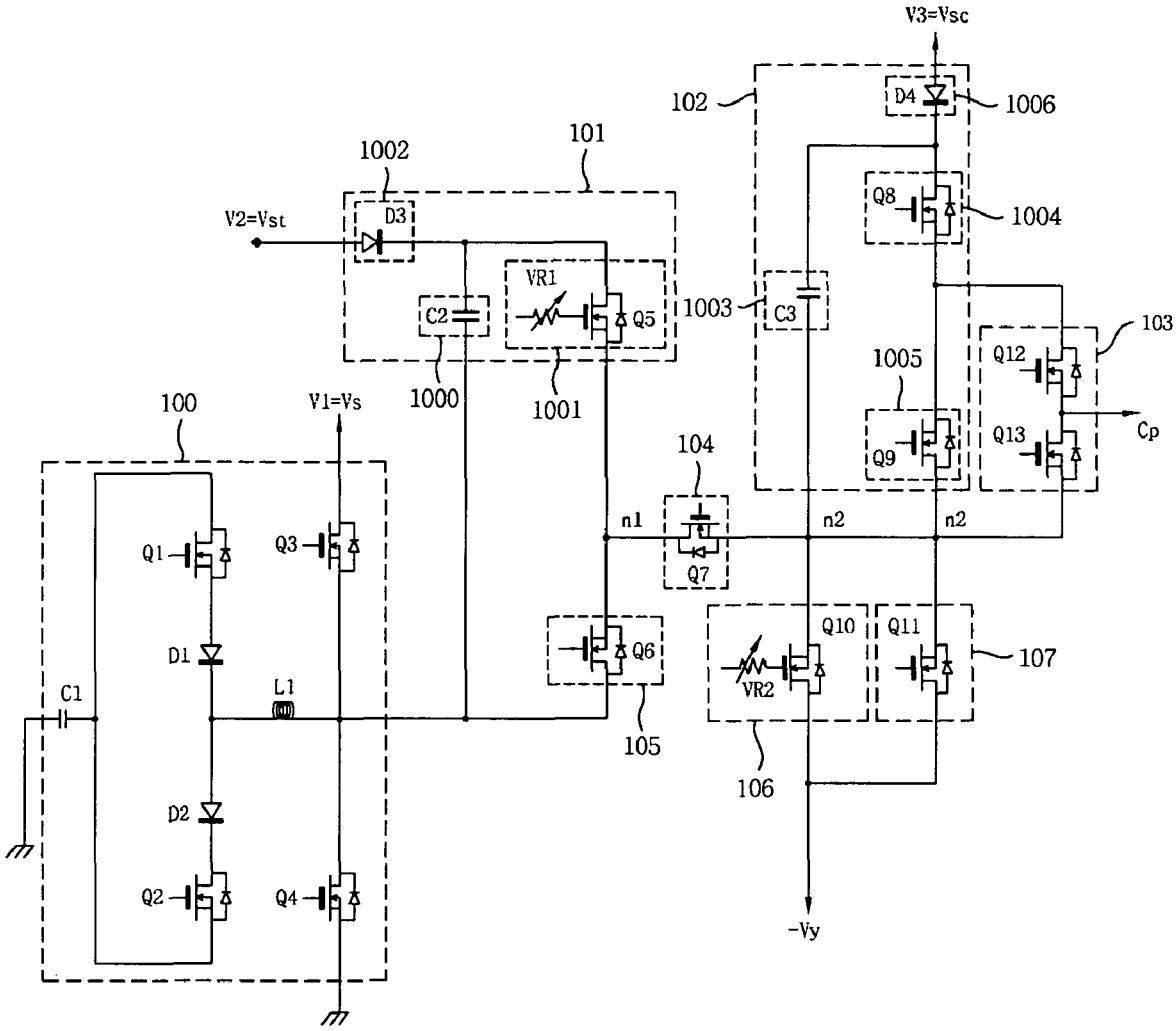
FIG. 10 is a circuit diagram of a plasma display apparatus according to a third embodiment of the present invention.

FIG. 10 is a circuit diagram of a third embodiment of a plasma display apparatus according to the present invention. As shown in the figure, the third embodiment of the driving apparatus of the plasma display panel of the present invention includes a first voltage supply unit 100, a second voltage supply unit 101, a third voltage supply unit 102, a driving signal output unit 103, a setdown supply unit 106, a negative polarity voltage supply unit 107, a first current path control unit 104, and a second current path control unit 105. At this time, the first current path control unit 104 is connected between the second voltage supply unit 101 and the driving signal output unit 103. The second current path control unit 105 is connected between the second voltage supply unit 101 and the first voltage supply unit 100. That is, in FIG. 10, the second variable resistor (VR2) positioned in the gate terminal of the eighth switch (Q8) is omitted, compared with FIG. 8.

The second voltage supply unit 101 includes a ramp-up generator 1001 and a first countercurrent interceptor 1002 connected between the setup voltage source (V2=Vst) that is the second voltage and the first node (n1) and the second voltage storage unit 1000 provided between the first voltage supply unit 100 and the setup voltage source (V2=Vst).

The first countercurrent interceptor 1002 includes the third diode (D3) and intercepts a backward current flowing from the second voltage storage unit 1000 toward the setup voltage source (V2=Vst).

The second voltage storage unit 1000 includes the second capacitor (C2) for storing the setup voltage (V2=Vst), adds the sustain voltage (Vs) to a voltage of the setup voltage source (V2=Vst) supplied from the first voltage supply unit 100, and then supplies the sum voltage to the ramp-up generator 1001.

The ramp-up generator 1001 includes the fifth switch (Q5). At this time, the variable resistor (VR1) is attached to the gate terminal of the fifth switch (Q5). Further, the fifth switch (Q5) of the ramp-up generator 1001 is switched by responding to a control signal that is not shown during the reset period and thus supplies the setup voltage (V2=Vst) to the first node (n1).

The third voltage supply unit 102 includes a third voltage storage unit 1003 connected between the scan voltage source (V3=Vsc) that is the third voltage and the second node (n2), a third voltage supply control unit 1004 and a current path selection control unit 1005 connected between the scan voltage source (V3=Vsc) and the second node (n2), and a second countercurrent interceptor 1006 connected between the scan voltage source (V3=Vsc) and the third voltage supply control unit 1004 or the third voltage storage unit 1003.

The current path selection control unit 1005 includes the ninth switch (Q9).

The second countercurrent interceptor 1006 includes the fourth diode (D4) and is provided to intercept a backward current flowing from the third voltage storage unit 1003 toward the scan voltage source (V3=Vsc).

The third voltage supply control unit 1004 includes the eighth switch (Q8) and controls the scan voltage (V3=Vsc) stored in the third voltage storage unit 1003 to be supplied to the driving signal output unit 103 during the setup period. That is, the third voltage supply control unit 1004 controls the supply of the scan voltage (V3=Vsc) during the setup period. The other terminal of the third voltage supply control unit 1004 is commonly connected to the other terminal of the current path selection control unit 1005 and the other terminal of the driving signal output unit 103. Here, the eighth switch (Q8) of the third voltage supply control unit 1004 is turned-on during the setup period of the reset period and thus transmits the setup voltage to the panel (Cp). Further, while the eighth switch (Q8) and the ninth switch (Q9) of the current path selection control unit 1005 are switched by a control signal supplied from a timing controller during the address period, they supply a voltage of the scan voltage source (V3=Vsc) to the driving signal output unit 103.

The third voltage storage unit 1003 includes the third capacitor (C3) for storing the scan voltage (V3=Vsc) that is the third voltage and one terminal of the third voltage storage unit 1003 is commonly connected to one terminal of the driving signal output unit 103, one terminal of the first current path control unit 104, and one terminal of the current path selection control unit 1005, and the other terminal thereof is commonly connected to one terminal of the second countercurrent interceptor 106 and one terminal of a third voltage supply control unit 1004. Further, a voltage supplied through the ramp-up generator 1001 during the reset period is added to scan voltage (V3=Vsc) which has been previously stored in the third capacitor (C3) and then the sum voltage is supplied to a third voltage supply control unit 1004. That is, a voltage (Vs+Vsc+Vst) is supplied to the third voltage supply control unit 1004.

A process of generating a reset waveform of the reset period in the driving apparatus of the plasma display panel according to the present invention will be described with reference to FIG. 11.

Figure 11:
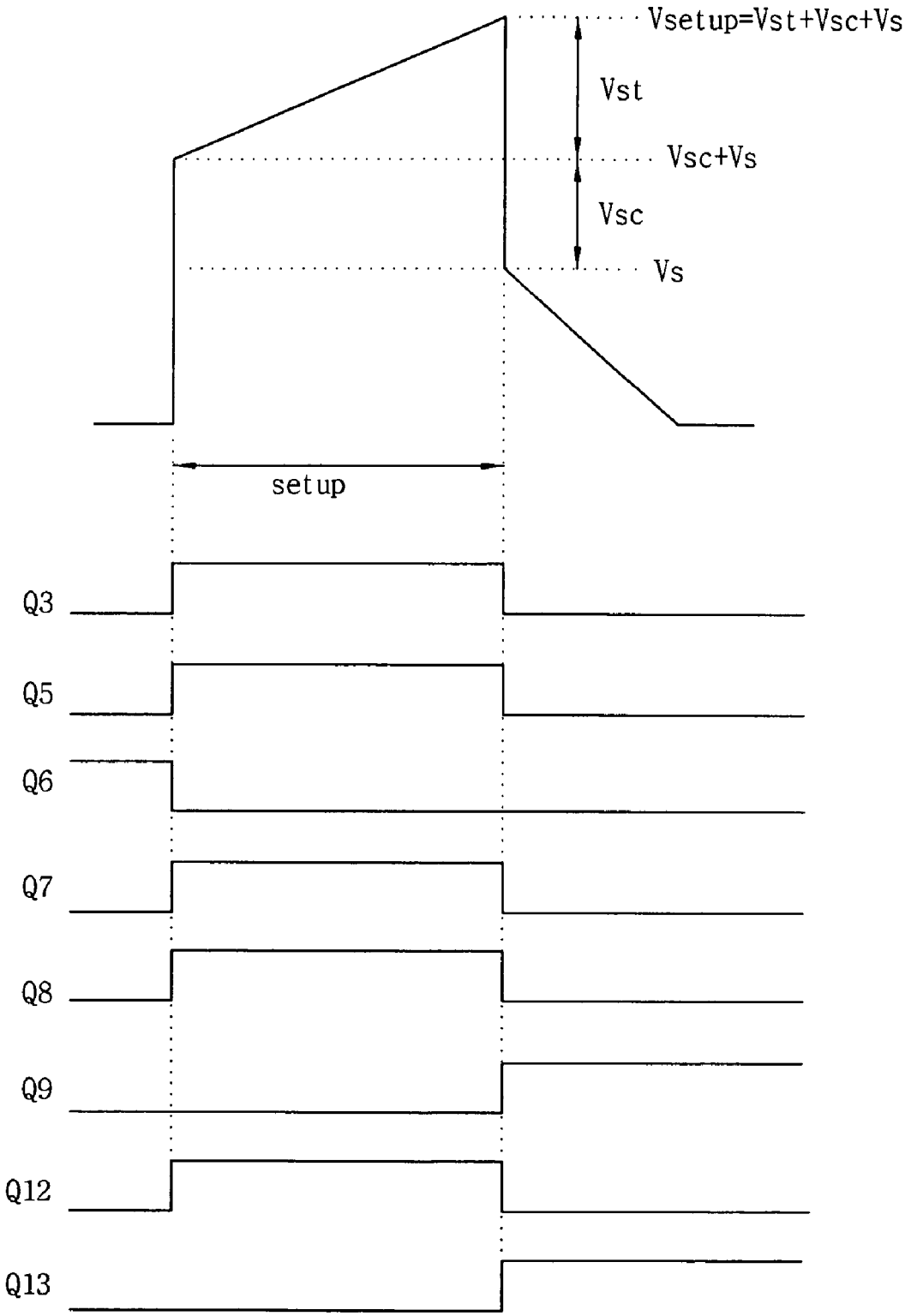
FIG. 11 is a timing chart illustrating driving waveforms and switch timing according to an operation of the third embodiment of the present invention.

FIG. 11 is a timing chart illustrating driving waveforms and switch timing according to an operation of the third embodiment of the present invention. Here, it is supposed that the voltage (V2=Vst) of the setup voltage source is charged in the second capacitor (C2) of the second voltage storage unit 1000 and the voltage (V3=Vsc) of the scan voltage source is charged in the third capacitor (C3) of the third voltage storage unit 1003.

First, during the setup period of the reset period, the third switch (Q3) of the first voltage supply unit 100, the fifth switch (Q5) of the ramp-up generator 1001, the seventh switch (Q7) of the first current path control unit 104, the eighth switch (Q8) of the third voltage supply control unit 1004, and the twelfth switch (Q12) of the driving signal output unit 103 are turned-on. The sixth switch (Q6) of the second current path control unit 105 is turned-off and the ninth switch (Q9) of the current path selection control unit 1005 and the thirteenth switch (Q13) of the driving signal output unit 103 maintain a turn-off state.

At this time, the sustain voltage (V1=Vs) that is the first voltage from the first voltage supply unit 100 is supplied. The sustain voltage (V1=Vs) supplied from the first voltage supply unit 100 is supplied to the panel (Cp) via an inside diode of the sixth switch (Q6), the seventh switch (Q7), the third capacitor (C3) of the third voltage storage unit 1003, the eighth switch (Q8), and twelfth switch (Q12). Therefore, the scan voltage (V3=Vsc) stored in the third capacitor (C3) of the third voltage storage unit 1003 is added to the sustain voltage (V1=Vs) supplied from the first voltage supply unit 100 and then the sum voltage is supplied to the panel (Cp), so that the voltage (Vs+Vsc) of the panel (Cp) is rapidly raised.

On the other hand, the setup voltage (Vst) stored in the second capacitor (C2) of the second voltage storage unit 1000 is added to the voltage (V1=Vs) of the sustain voltage source and then the sum voltage is supplied to the fifth switch (Q5) of the ramp-up generator 1001. While the ramp-up generator 1001 adjusts a channel width with variable resistor (VR1) provided in the gate terminal of the fifth switch (Q5), it supplies the voltage supplied from the second capacitor (C2) to the first node (n1) in a predetermined slope. A voltage applied to the first node (n1) in a predetermined slope is supplied to the panel (Cp) via the seventh switch (Q7), the third capacitor (C3), and the twelfth switch (Q12). At this time, the ramp-up pulse is supplied to the panel (Cp). Here, a ramp-up pulse applied to the panel (Cp) raises to the voltage (Vs+Vsc+Vst) from the voltage (Vs+Vsc). That is, the voltage in a start point of the ramp-up pulse is raised to the voltage (Vs+Vsc) instead of the voltage Vs. Accordingly, a voltage at a last point of the ramp-up pulse is also raised to the voltage (Vs+Vsc+Vst).

That is, when the sustain voltage (V1=Vs) is applied to the first voltage supply unit 100, the second voltage supply unit 101 generates a ramp-up pulse rising from the sustain voltage (V1=Vs) to a sum voltage (Vs+Vst) of the sustain voltage and the setup voltage. At this time, because the ramp-up pulse is applied to the third capacitor (C3) and the third voltage supply control unit 1004 is turned-on, a pulse applied to the panel has a waveform rising from the voltage (Vs+Vst) to the voltage (Vs+Vst+Vsc).

In addition, after the ramp-up pulse is supplied to the panel (Cp), the third switch (Q3), the fifth switch (Q5), the seventh switch (Q7), the eighth switch (Q8), and the tenth switch (Q10) are turned-off, the sixth switch (Q6) maintains a turn-off state, and the ninth switch (Q9) and the eleventh switch (Q11) are turned-on. When the fifth switch (Q5) and the twelfth switch (Q12) are turned-off, only the voltage Vs supplied from the first voltage supply unit 100 is temporary applied to the first node (n1), so that the voltage of the panel (Cp) is rapidly fallen to the voltage Vs.

While the second voltage supply unit 101 and the third voltage supply unit 102 repeats such a process, they supply a ramp-up pulse having a relatively high voltage to the panel (Cp) during the reset period.

Accordingly, the reset voltage is further raised at the reset period of the plasma display panel and thus a more efficient reset operation is performed, so that a drive efficiency is improved when driven.

The Fourth Embodiment

Figure 12:
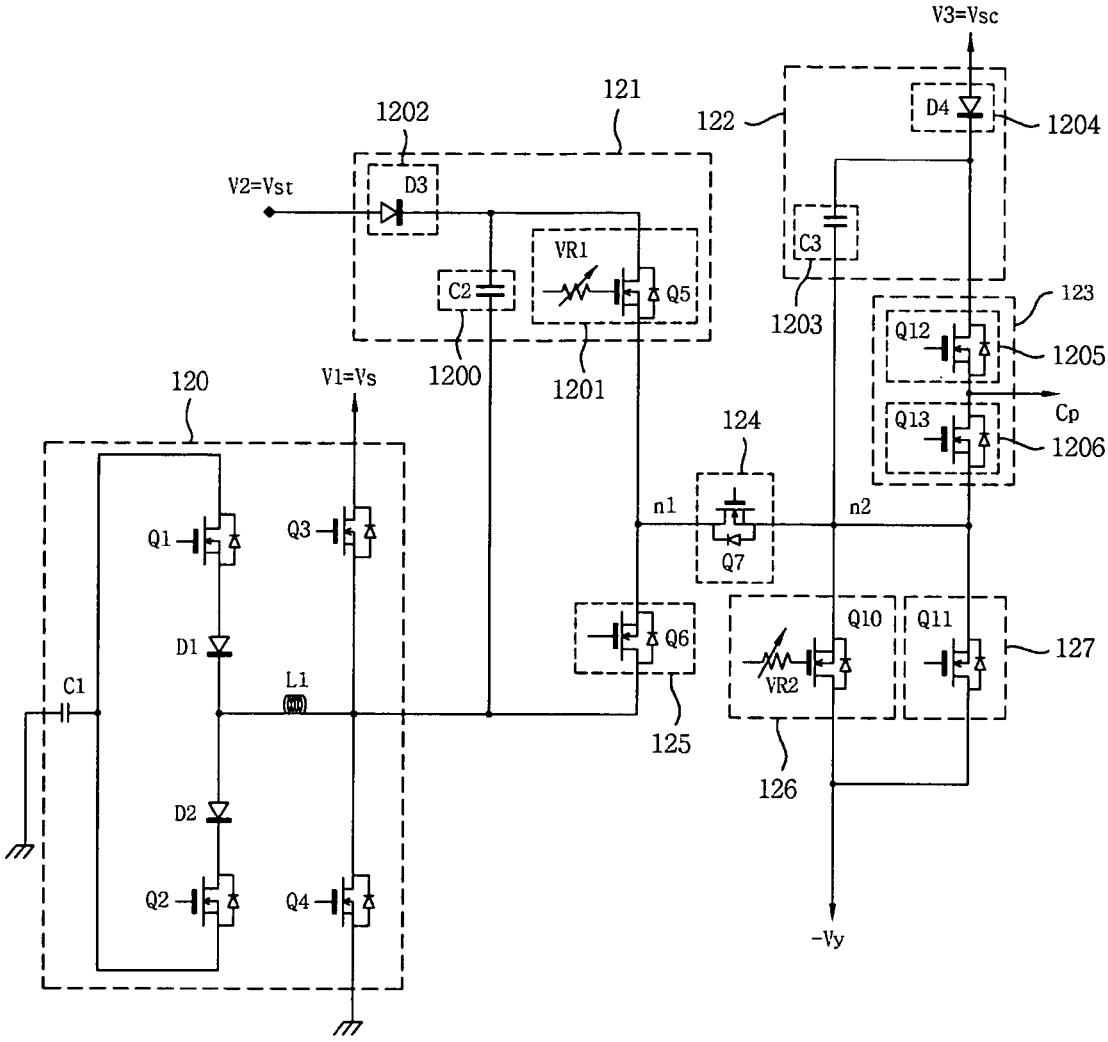
FIG. 12 is a circuit diagram of a fourth embodiment of a driving apparatus of a plasma display panel according to the present invention.

FIG. 12 is a circuit diagram of a fourth embodiment of the driving apparatus of the plasma display panel according to the present invention. As shown in the figure, the fourth embodiment of the driving apparatus of the plasma display panel according to the present invention includes the first voltage supply unit 120, the second voltage supply unit 121, the third voltage supply unit 122, the current path selection and driving signal output unit 123, the setdown supply unit 126, the negative polarity voltage supply unit 127, the first current path control unit 124, and the second current path control unit 125. The first current path control unit 124 is connected between the second voltage supply unit 121 and the current path selection and driving signal output unit 123. The second current path control unit 125 is connected between the second voltage supply unit 121 and the first voltage supply unit 120. That is, in FIG. 12, the eighth switch (Q8) and the ninth switch (Q9) of the third voltage supply unit shown in FIG. 10 are omitted, compared with FIG. 10.

The second voltage supply unit 121 includes the first countercurrent interceptor 1202 and the ramp-up generator 1201 connected between the first node (n1) and the setup voltage source (V2=Vst) that is the second voltage and the second voltage storage unit 1200 provided between the setup voltage source (V2=Vst) and the first voltage supply unit 120.

The first countercurrent interceptor 1202 includes the third diode (D3) and intercepts a backward current flowing from the second voltage storage unit 1200 toward the setup voltage source (V2=Vst).

The second voltage storage unit 1200 includes the second capacitor (C2) for storing the setup voltage (V2=Vst) and adds a voltage of the setup voltage source (V2=Vst) to the sustain voltage (V1=Vs) that is the first voltage supplied from the first voltage supply unit 120 and then the sum voltage is supplied to the ramp-up generator 1201.

The ramp-up generator 1201 includes the fifth switch (Q5). The variable resistor (VR1) is attached to the gate terminal of the fifth switch (Q5). Further, the fifth switch (Q5) of the ramp-up generator 1201 is switched by responding to a control signal that is not shown during the reset period and thus supplies the setup voltage (V2=Vst) to the first node (n1).

The third voltage supply unit 122 includes the second voltage storage unit 1200 connected between the scan voltage source (V3=Vsc) for supplying the third voltage and the second node (n2). Further, the second countercurrent interceptor 1204 is provided between the scan voltage source and the second voltage storage unit 1200 or the current path selection and driving signal output unit 123.

The second voltage storage unit 1200 includes the third capacitor (C3) for storing the scan voltage (V3=Vsc) that is the third voltage. One terminal of the second voltage storage unit 1200 is commonly connected to one terminal of the current path selection and driving signal output unit 123 and one terminal of the first current path control unit 124 and the other terminal thereof is commonly connected to one terminal of the second countercurrent interceptor 1204 and the other terminal of the current path selection and driving signal output unit 123.

The second countercurrent interceptor 1204 includes a fourth diode (D4) for intercepting a backward current flowing from the third capacitor (C3) of the second voltage storage unit 1200 toward the scan voltage source (V3=Vsc).

The current path selection and driving signal output unit 123 includes the first current path selection control unit 1205 and the second current path selection control unit 1206. Further, the current path selection and driving signal output unit 123 outputs a driving signal applied from a position between the first current path selection control unit 1205 and the second current path selection control unit 1206 to the panel (Cp).

The first current path selection control unit 1205 includes the twelfth switch (Q12) and supplies the setup voltage to the panel (Cp) during the setup period of the reset period.

The second current path selection control unit 1206 includes the thirteenth switch (Q13) and supplies the setdown voltage to the panel (Cp) during the setdown period of the reset period.

A process of generating a reset waveform of the reset period of the driving apparatus of the plasma display panel according to the present invention will be described with reference to FIG. 13.

Figure 13:
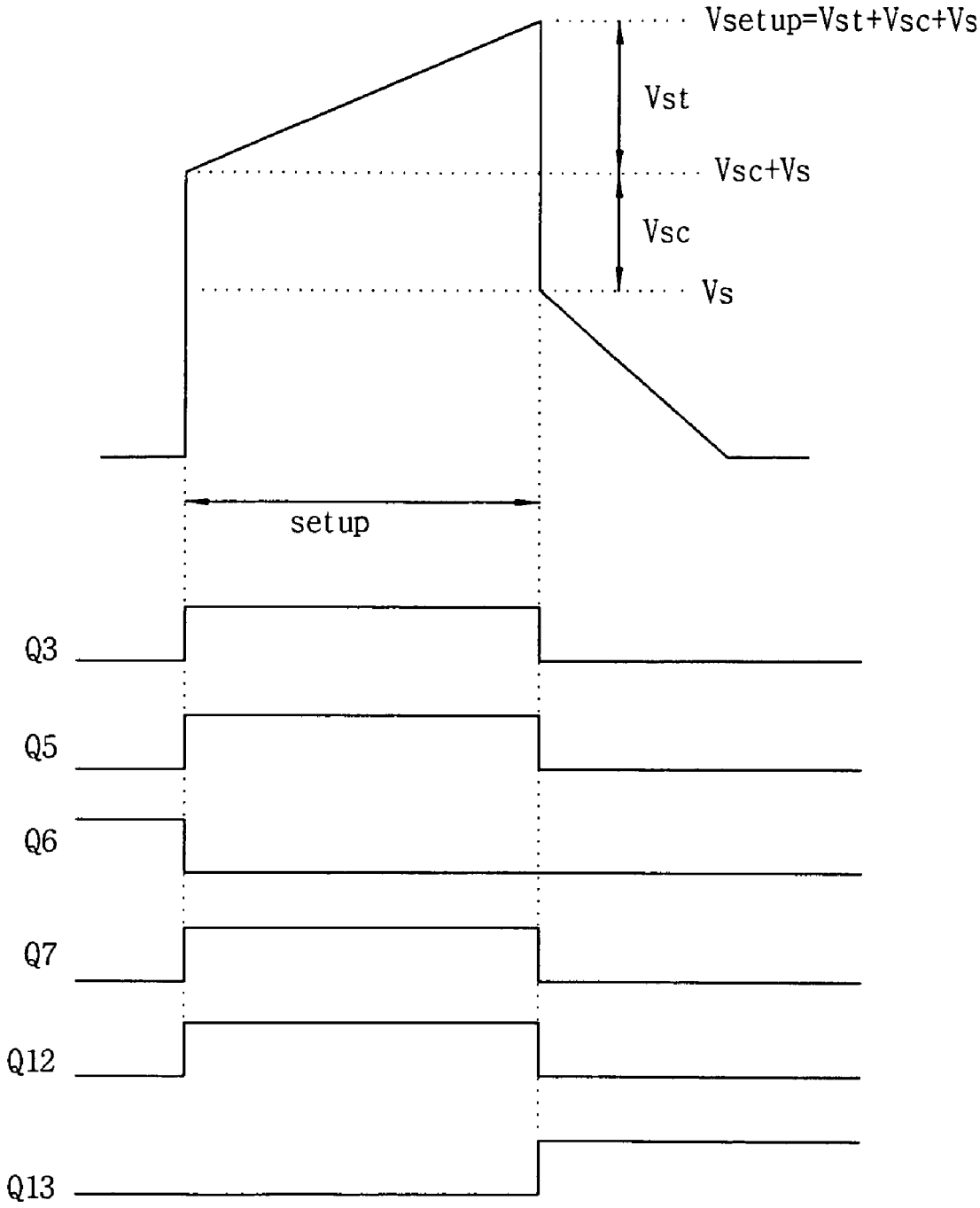
FIG. 13 is a timing chart illustrating driving waveforms and switch timing according to an operation of the fourth embodiment of the present invention.

FIG. 13 is a timing chart illustrating a switching operation according to a driving method of generating a ramp-up pulse at the reset period of the driving apparatus of the plasma display panel shown in FIG. 12. Here, it is supposed that the voltage (Vst) of the setup voltage source is charged in the second capacitor (C2) of the second voltage storage unit 1200 and the voltage (Vsc) of the scan voltage source is charged in the third capacitor (C3) of the third voltage storage unit 1203.

First, during the setup period of the reset period, the twelfth switch (Q12) of the first current path selection control unit 1205 included in the third switch (Q3) of the first voltage supply unit 120, the fifth switch (Q5) of the ramp-up generator 1201, the seventh switch (Q7) of the first current path control unit 124, and the current path selection and driving signal output unit 123 is turned-on, the sixth switch (Q6) of the second current path control unit 125 is turned-off, and the thirteenth switch (Q13) of the second current path selection control unit 1206 included in the current path selection and driving signal output unit 123 maintains a turn-off state.

At this time, the sustain voltage (V1=Vs) is supplied from the first voltage supply unit 120. The sustain voltage (Vs) supplied from the first voltage supply unit 120 is supplied to the panel (Cp) via an inside diode of the sixth switch (Q6), the seventh switch (Q7), the third capacitor (C3) of the third voltage storage unit 1203, and the twelfth switch (Q12) of the first current path selection control unit 1205. Therefore, the voltage of the panel (Cp) is rapidly raised to the voltage (Vs+Vsc).

On the other hand, the setup voltage (V2=Vst) stored in the second capacitor (C2) of the second voltage storage unit 1200 is added to the voltage (V1=Vs) of the sustain voltage source and thus the sum voltage is supplied to the fifth switch (Q5) of the ramp-up generator 1201. While the ramp-up generator 1201 adjusts a channel width with the variable resistor (VR1) provided in the gate terminal of the fifth switch (Q5), it supplies the voltage supplied from the second capacitor (C2) to the first node (n1) in a predetermined slope. The voltage applied to the first node (n1) in a predetermined slope is supplied to the panel (Cp) via the seventh switch (Q7), the third capacitor (C3), and the twelfth switch (Q12). At this time, the ramp-up pulse is supplied to the panel (Cp). The ramp-up pulse applied to the panel (Cp) is raised from a voltage (Vs+Vsc) to a voltage (Vs+Vsc+Vst).

While the second voltage supply unit 121 and the scan voltage supply unit 123 repeat such a process, they supply a ramp-up pulse of a relatively high voltage to the panel (Cp) during the reset period.

Accordingly, the reset voltage is further raised even though the number of components of the driving apparatus of the plasma display panel is reduced and thus a more efficient reset operation is performed, so that a driving efficiency is improved when driven and the production cost of the driving apparatus is decreased.

Figure 14:
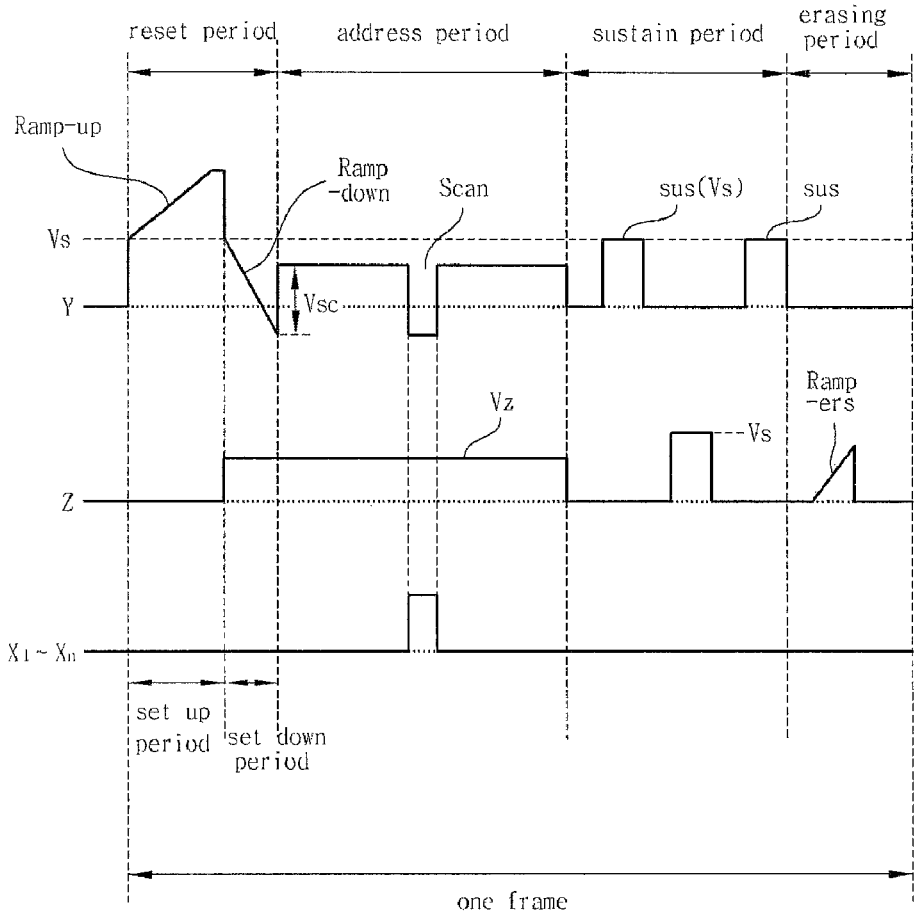
FIG. 14 is a diagram illustrating driving waveforms according to a driving method of the plasma display apparatus of the present invention.

FIG. 14 is a diagram illustrating driving waveforms according to a driving method of the plasma display apparatus of the resent invention. As shown in FIG. 14, the plasma display apparatus is driven by dividing the period into the reset period for initializing all cells, the address period for selecting cells to discharge, the sustain period for sustaining the discharge of the selected cell, and an erasing period for erasing wall charges within the discharge cell.

At the reset period, a reset waveform is applied to all scan electrodes Y. The description of the reset waveform has been described above in detail.

At the address period, the scan voltage (Vsc) is applied to the scan electrodes Y, and the scan signal is applied to the scan electrodes Y.

When a negative polarity scan signal is sequentially applied to the scan electrodes Y, a positive polarity data signal is applied to the address electrode X. An address discharge is generated within the discharge cells to which the data signal is applied while the wall voltage generated at the reset period is added to the voltage difference of the scan signal and the data signal. Wall charges enough to cause the discharge are formed when the sustain voltage (Vs) is applied within cells selected by the address discharge. A positive polarity voltage (Vz) is supplied to the sustain electrode to prevent mis-discharge from generating between the sustain electrode Z and the scan electrode Y by decreasing the voltage difference from the scan electrode Y during the set-down period and the address period.

At the sustain period, sustain signals (Sus) having a sustain voltage (Vs) are alternatively applied to the scan electrode Y and the sustain electrodes Z. A cell selected by the address discharge generates the sustain discharge (that is, display discharge between the scan electrode and the sustain electrode) whenever each sustain signal is applied while a sustain signal is added to the wall voltage within the cell.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel including a scan electrode and a sustain electrode; and a driver applying a reset signal to the scan electrode at a reset period;

wherein the reset signal substantially perpendicularly rises from a ground level voltage to a first voltage and gradually rises from the first voltage to a second voltage with a predetermined constant slope and then substantially perpendicularly falls from the second voltage to a third voltage at a setup period of the reset period, and the reset signal gradually falls from a third voltage to a fourth voltage at a setdown period that follows the setup period, wherein the third voltage is less than the first voltage and the third voltage is greater than the ground level voltage, the third voltage is a sustain voltage for sustaining sustain discharge, the first voltage is a sum voltage of the sustain voltage and a scan voltage, and the scan voltage is applied to the scan electrodes at an address period following the reset period.

2. The plasma display apparatus of claim 1, wherein the sustain voltage is supplied from a first voltage supply unit and the scan voltage is stored in a second voltage storage unit, the scan voltage is added to the sustain voltage.

3. The plasma display apparatus of claim 1, wherein the second voltage is a sum voltage of the first voltage and a setup voltage.

4. The plasma display apparatus of claim 3, wherein the setup voltage is stored in a first voltage storage unit.

* * * * *